United States Patent [19]

Bender et al.

[11] Patent Number: 4,982,668

[45] Date of Patent: Jan. 8, 1991

[54] FRAGMENTATION PLATE FOR THE EXTERIOR OF AN EXPLOSIVE CHARGE DEVICE

[75] Inventors: Peter Bender, Kaarst; Heribert Rohrbeck, Dusseldorf, both of Fed. Rep. of Germany

[73] Assignee: Rheinmetall GmbH, Düsseldorf, Fed. Rep. of Germany

[21] Appl. No.: 376,032

[22] Filed: Jul. 6, 1989

[30] Foreign Application Priority Data

Jul. 6, 1988 [DE] Fed. Rep. of Germany ..... 3822817

[51] Int. Cl.[5] ..... F42B 12/32

[52] U.S. Cl. ..... 102/495; 102/496

[58] Field of Search ..... 102/494, 495, 496, 497, 102/389, 506

[56] References Cited

U.S. PATENT DOCUMENTS

| | | | |
|---|---|---|---|
| 1,006,875 | 10/1911 | Puff | 102/494 |
| 3,298,308 | 1/1967 | Throner, Jr. | 102/496 |
| 3,667,390 | 6/1972 | Medin et al. . | |
| 4,648,323 | 3/1987 | Lawther . | |

FOREIGN PATENT DOCUMENTS

| | | |
|---|---|---|
| 236256 | 10/1964 | Austria . |
| 1578142 | 7/1972 | Fed. Rep. of Germany . |
| 2536308 | 2/1977 | Fed. Rep. of Germany . |
| 2821723 | 11/1978 | Fed. Rep. of Germany . |
| 2907308 | 12/1982 | Fed. Rep. of Germany . |
| 3625965 | 2/1988 | Fed. Rep. of Germany . |
| 3703773 | 8/1988 | Fed. Rep. of Germany . |
| 3822375 | 4/1989 | Fed. Rep. of Germany . |
| 140945 | 5/1978 | Norway . |
| 352727 | 1/1973 | Sweden . |
| 56166 | 4/1911 | Switzerland . |
| 543064 | 11/1973 | Switzerland . |

*Primary Examiner*—Harold J. Tudor
*Attorney, Agent, or Firm*—Spencer & Frank

[57] ABSTRACT

A fragmentation plate composed of juxtaposed contacting metal bodies or fragmentation elements which is to be disposed in front of an explosive charge in an explosive grenade or other projectile, for example a subprojectile. The metal bodies or fragmentation elements, for example, metal balls, are held, at least on the side of the plate facing the explosive, by a tray or shell, for example of sheet metal. The tray or shell may be perforated, i.e. provided with holes, for the metal bodies. Moreover, an encasing substance may be disposed between the tray and the bodies and over the outer surfaces of the metal bodies. Additionally, the fragmentation plate may have an outer covering shell or tray.

15 Claims, 4 Drawing Sheets

FIG. 1A
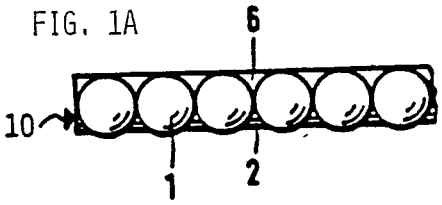
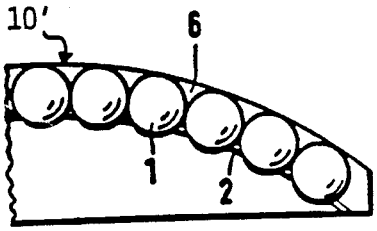
FIG. 1B
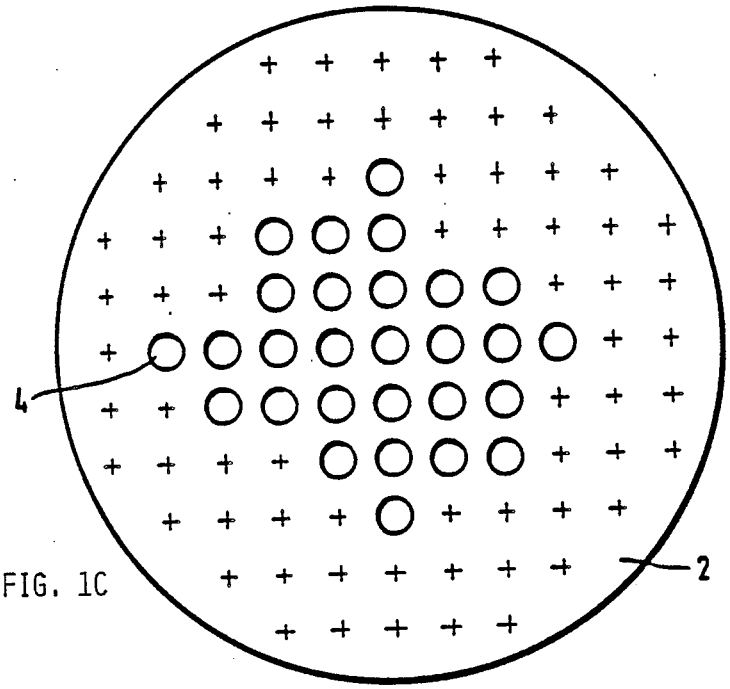
FIG. 1C
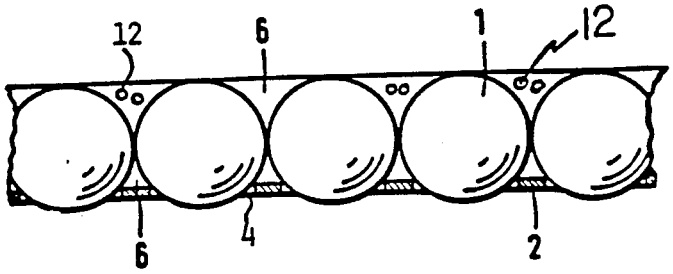
FIG. 1D

FRAGMENTATION PLATE FOR THE EXTERIOR OF AN EXPLOSIVE CHARGE DEVICE

BACKGROUND OF THE INVENTION

The present invention relates to a fragmentation plate for the exterior of an explosive charge device, with the plate including a plurality of metal fragmentation elements, particularly heavy metal bodies positioned adjacent and contacting one another and with each fragmentation element having a spherical surface portion oriented toward the exterior face of the fragmentation plate.

Fragmentation plates of the above type, including fragmentation elements or metal bodies in the form of balls or balls having flattened circumferential portions provide a hexagonal cross-section, are arranged along the circumference of an explosive charge for an explosive grenade or some other projectile.

Depending on whether the fragmentation elements are to be ejected in parallel or are to be bundled in a predetermined ejection direction, the fragmentation plate may be planar or, with respect to the explosive, concave or convex. Such fragmentation plates may also be arranged in sub-projectiles of launched projectiles where these sub-projectiles are successively ignited or ejected. The prior art is described, for example, in U.S. Pat. No. 3,667,390 and in German Patents Nos. 2,821,723 and 2,907,308, incorporated herein by reference.

One drawback in the prior art arrangements is the complicated manufacturing process necessary because the individual spherical fragmentation elements must be soldered together and the surface of the plate must be encased in hard solder. As a result of this manufacturing process, assembly plates are required to hold the individual metal bodies (fragmentation elements) in position during manufacture of the fragmentation plate.

Another drawback of the prior art arrangements is that reliable sealing of the spherical fragmentation elements against the explosion gases cannot be achieved. Since the fragmentation elements contact one another only at individual contact points or at contacting slide surfaces in the form of the smooth flattened portions in varying degrees of firmness. This results in the inability to ensure the simultaneous ejection of the elements in the intended direction.

SUMMARY OF THE INVENTION

It is therefore an object of the present invention to improve a fragmentation plate of the type described above so that its manufacture is possible without significant assembly aids and, to ensure that ejection of the spherical bodies always occurs simultaneously and uniformly in the desired direction once the appropriate ejection pressure has built up behind the fragmentation plate. A further object is to improve the effectiveness of the fragmentation plate.

The above objects are generally achieved according to the present invention by providing the fragmentation plate with a shell or tray, e.g. of sheet metal, which holds the fragmentation elements, and which is disposed at least on the inner surface of the fragmentation plate and separates the fragmentation elements from the explosive charge. Preferred shapes for the fragmentation elements, and for the shell or tray and various further features of the present invention are likewise disclosed.

The inner shell or tray according to the invention employed on the explosive side of the fragmentation elements can also serve as an assembly plate. This shell also ensures that ejection of the fragmentation elements occurs only after a uniform pressure has built up behind this shell. This results in the realization of greater fragment velocity for the fragmentation elements than had previously been possible.

BRIEF DESCRIPTION OF THE DRAWINGS

FIG. 1A, is a side cross-sectional view of a portion of a planar fragmentation plate according to a first embodiment of the present invention.

FIG. 1B, is a side cross-sectional view of a portion of a convex fragmentation plate according to a first embodiment of the present invention.

FIG. 1C is a top view of the inner shell member for the fragmentation plates according to the present invention shown in FIGS. 1A and 1B.

FIG. 1D is a detailed cross-sectional view of the fragmentation plate of FIG. 1A.

FIGS. 2D–F are a top and two different side views respectively of the fragmentation elements of the fragmentation plate of FIGS. 2A14 C.

DESCRIPTION OF THE PREFERRED EMBODIMENTS

Figure 2A:
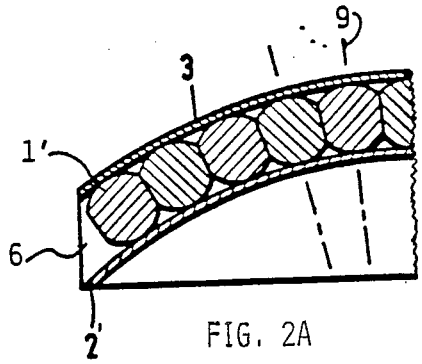
FIG. 2A is a partial side cross-sectional view of a second embodiment of the fragment plate according to the present invention taken along line A—A of FIG. 2C.

The fragmentation plates illustrated in the four embodiments of FIGS. 1 to 4 each include an inner shell or tray 2, and a plurality of fragmentation elements 1. These four different embodiments of the novel fragmentation plate, illustrate the use of differently shaped fragmentation elements and correspondingly configured inner shells and outer casings where necessary.

FIG. 1A illustrates, a planar fragmentation plate 10, while FIG. 1B illustrates a convex fragmentation plate 10' both plates include spherical metal fragmentation elements 1 which can for example be comprised of a heavy metal. FIG. 1C illustrates the inner shell or tray 2 in the form of a perforated metal sheet equipped with holes 4 (only some of which are fully illustrated) to accommodate the spherical fragmentation elements 1.

As illustrated in FIG. 1D, each of the fragmentation elements 1 rest in a respective hole 4 of the shell 2. An encasing substance 6, e.g. of plastic adhesive or solder, fills in the area above the fragmentation elements 1 and in the spaces between the shell 2 and the fragmentation elements 1. Small additional bodies 12 of metal, ceramic or the like, (which may be spherically shaped for example), may be arranged in the upper portion of the encasing substance 6 between the individual fragmentation elements 1 so as to broaden the dispersive effect of the fragmentation plate against soft targets.

Figure 2B:
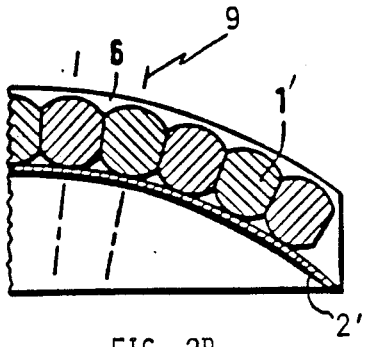
FIG. 2B is a partial side cross-sectional view of an alternate second embodiment of the fragment plate of the present invention according to FIG. 2A.
Figure 2C:
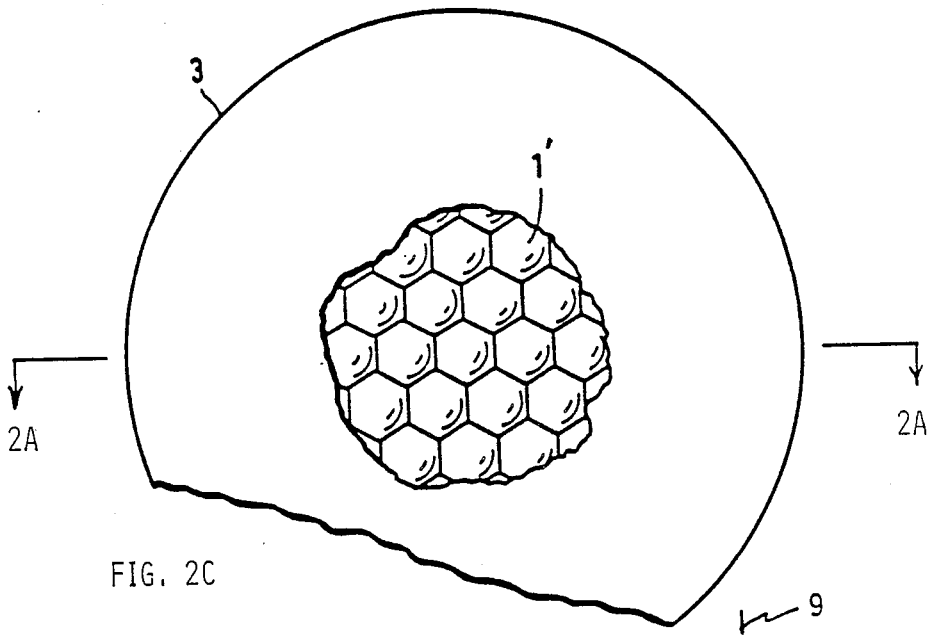
FIG. 2C is a top partial cut-away view of the fragmentation plate of FIG. 2A.
Figure 2D:
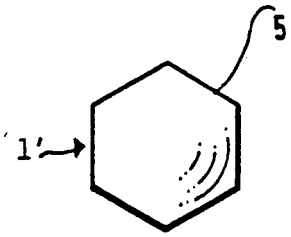
Figure 2D:
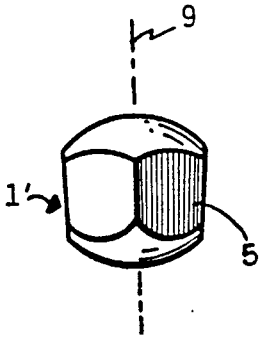

In the embodiment of the invention shown in FIGS. 2A–D, the convex fragmentation plate includes metal fragmentation elements 1' which are generally spherical (or balls) with flattened planar side faces 5, and a preferably nonperforated inner shell or tray 2'. However, if desired a perforated inner shell or tray 2 as shown in FIG. 1C may be used. The planar faces 5 are arranged edge to edge about a common circumference of the sphere so that the element 1' presents a regular polygon shape, i.e, preferably a hexagon shape as shown, when viewed from the top or bottom as illustrated in FIG. 2D. The fragmentation plate can be provided, as shown in FIG. 2A, with an outer shell casing 3 formed for example of metal, or as shown in FIG. 2B, can be formed without an outer casing, wherein only casting substance 6 is provided on the exterior of the fragmentation elements 1'.

Figure 2F:
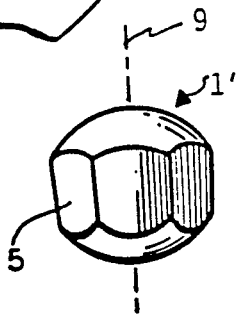
Figure 3A:
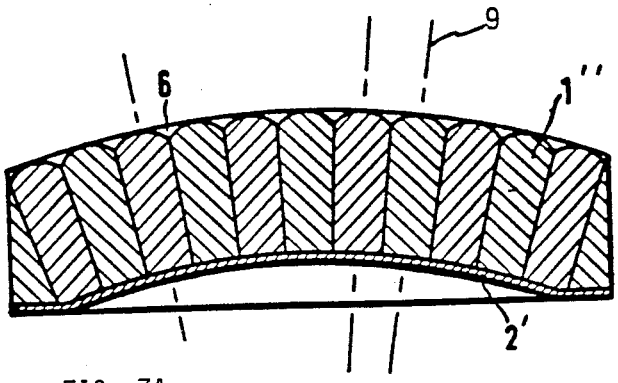
FIG. 3A is a side cross-sectional view of a third embodiment of the fragmentation plate of the present invention taken along line A—A of FIG. 3B.
Figure 3B:
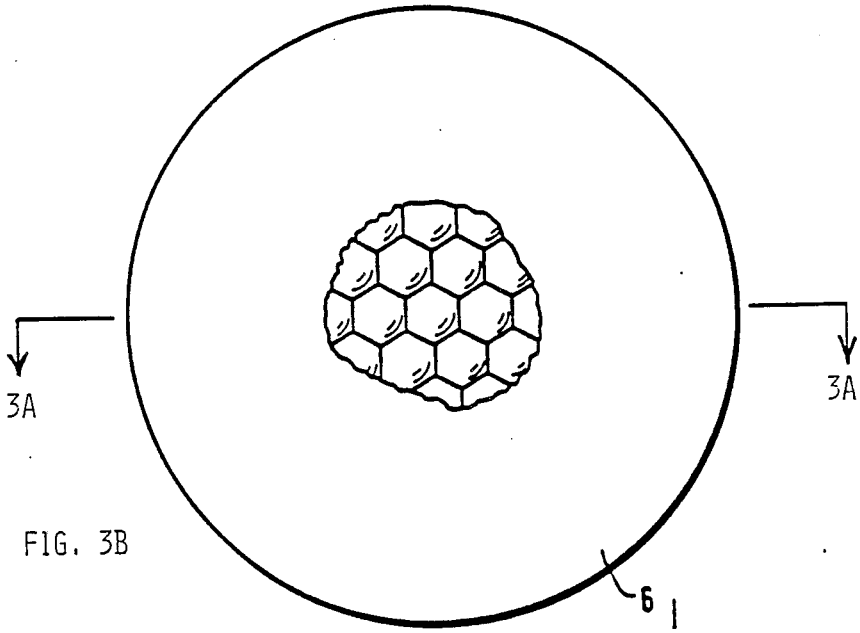
FIG. 3B is a top partial cut-away view of the fragmentation plate of FIG. 3A.
Figure 3C:
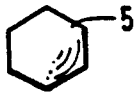
FIGS. 3C–E show a top and two different side views respectively of the fragmentation elements of the fragmentation plate of FIG. 3A.
Figure 3D:
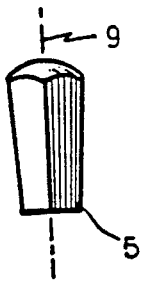
Figure 3F:
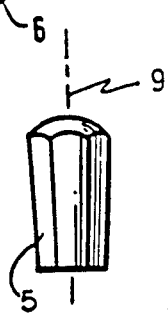

The flattened surface portions 5 of the hexagonal fragmentation elements 1', as illustrated in FIGS. 2E and 2F are tapered toward the interior of the explosive charge device, i.e., toward the inner shell or tray 2' so that when the elements 1' are assembled adjacent one another as illustrated in FIGS. 2A–3B, the extension lines 9 extending through the central axis of the respective elements 1' and from the respective flattened surface portion 5 are met in the center of the radius of curvature of the curved fragmentation plate.

The embodiment illustrated in FIGS. 3A to 3E corresponds closely to the embodiment of FIGS. 2A to 2F. However, in this embodiment, instead of hexagonal cross-section spherical fragmentation elements 1', elongated hexagonal prism shaped metal fragmentation elements 1" with a spherical end surface are employed, with the length to diameter ratio of the elements 1" lying approximately in a range of 3:1, compared to a length to diameter ratio of 1:1 for the spherical fragmentation elements 1'. The configuration of the fragmentation elements 1" according to FIGS. 3A–3E achieves a considerable increase in performance and particularly in the impact power carried by the individual elements.

Figure 4A:
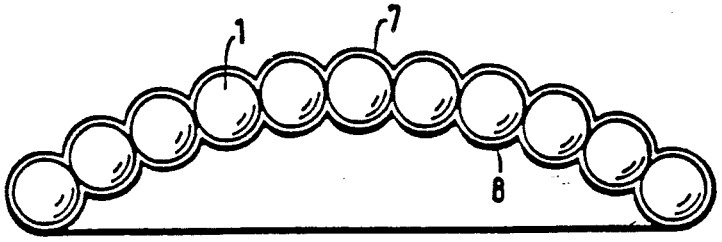
FIG. 4A is a side cross-sectional view of a fourth embodiment of a fragmentation plate according to the present invention taken along line A—A of FIG. 4B.
Figure 4B:
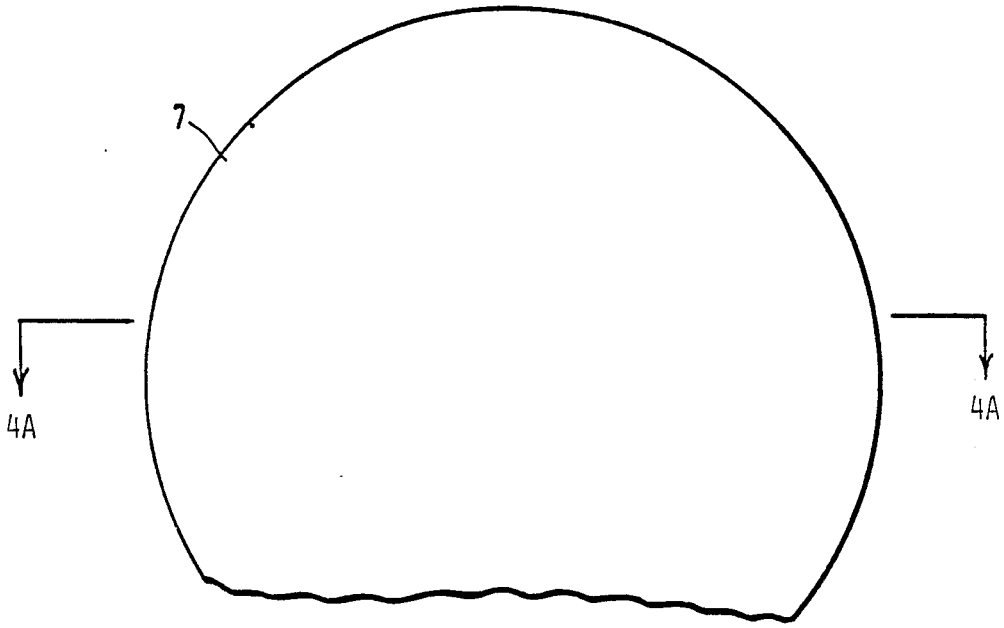
FIG. 4B is a top view of the fragmentation plate of FIG. 4A.
Figure 4C:
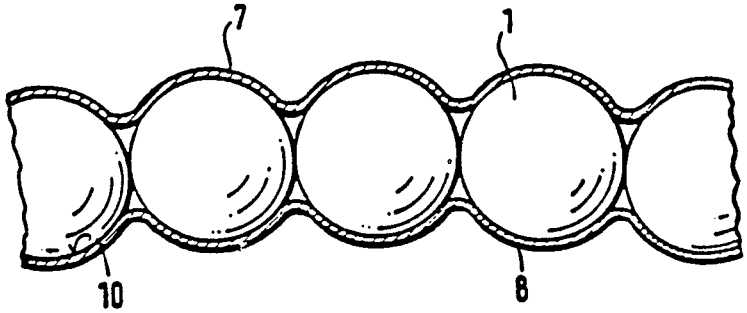
FIG. 4C is a detailed partial side cross-sectional view of the fragmentation plate of FIG. 4A.

FIGS. 4A to 4C illustrate an embodiment of the fragmentation plate including spherical fragmentation elements or balls 1 corresponding to the fragmentation elements illustrated in FIGS. 1A–1D. These fragmentation elements 1 are held between two deformed metal sheets 7 and 8 which serve as the outer casing and inner shell respectively. The interior surfaces of the metal sheets 7 and 8 may be covered with solder or with an adhesive sheet 10. The metal sheets 7 and 8 may be available before assembly as preformed plates, or as planar plates which are placed over the fragmentation elements 1 and are shaped during assembly in an isostatic pressing process to place them in form-locking contact with the fragmentation elements 1 as shown. If desired, fragmentation elements with flattened side surfaces, such as for example shown in FIGS. 2D–2F, may be used instead of the spherical elements or balls 1.

The invention now being fully described, it will be apparent to one of ordinary skill in the art that many changes and modifications can be made thereto without departing from the spirit or scope of the invention as set forth herein.

What is claimed is:

1. In a curved fragmentation plate for use in front of an explosive charge to form an outer portion of an explosive charge device, with said fragmentation plate having an inner face oriented toward an explosive charge, an outer face oriented away from the explosive charge, and comprising a plurality of metal fragmentation elements which are arranged adjacent and in contact with one another, with each fragmentation element having a spherical surface portion oriented toward "said outer face" of said fragmentation plate; the improvement wherein: an inner shell is disposed at and at least partially forms said inner face of said plate, and supports and holds said fragmentation elements; said fragmentation elements are provided with lateral flattened surface portions at their areas of contact with adjacent said fragmentation elements, with said lateral flattened surface portions being formed about a common circumference of each respective said element so that each said element has a cross-section in the form of a regular polygon; said flattened surface portions of each of said fragmentation elements are tapered toward said inner face; and said fragmentation elements are arranged such that the axes of said fragmentation elements and extension lines from said flattened surface portions of said fragmentation elements meet in the center of the radius of curvature of said curved fragmentation plate.

2. A fragmentation plate as defined in claim 1 wherein said plate is convex.

3. A fragmentation plate as defined in claim 1 wherein: said fragmentation elements each have a further spherical surface portion oriented toward said inner face of said plate.

4. A fragmentation plate as defined in claim 3 wherein said fragmentation elements are spherical elements provided with said flattened surface portions.

5. A fragmentation plate as defined in claim 1 wherein said polygon is a hexagon.

6. A fragmentation plate as defined in claim 1, wherein said fragmentation elements have a length to diameter ration of at least 1.

7. A fragmentation plate as defined in claim 6, wherein said fragmentation elements have a length to diameter ratio in the range between 3:1 and 5:1.

8. A fragmentation plate as defined in claim 1, further including:

an encasing substance of at least one of plastic, adhesive and solder covering at least said spherical surface portions of said fragmentation elements.

9. A fragmentation plate as defined in claim 8, wherein said encasing substance fills any spaces disposed between said fragmentation elements and said inner shell.

10. A fragmentation plate as defined in claim 8, further including:

small secondary bodies of metal or ceramic embedded in said encasing substance.

11. A fragmentation plate as defined in claim 1, wherein said fragmentation elements are connected to said inner shell by at least one of soldering, encasing with an encasing substance and gluing.

12. A fragmentation plate as defined in claim 1, further comprising:

an outer shell covering said spherical surface portions of said fragmentation elements and forming said outer face.

13. A fragmentation plate as defined in claim 12, wherein said fragmentation elements are connected to said outer shell by one of soldering, with an encasing substance and gluing.

14. A fragmentation plate as defined in claim 12 wherein at least one of said inner and outer shells is formed of sheet metal.

15. A fragmentation plate as defined in claim 12, wherein: said fragmentation elements have spherical surface portions oriented at least toward both said inner and outer faces of said fragmentation plate; and said outer and said inner shells are each shaped to correspond to said spherical shape of the respective outer and inner surface portion of said plurality of fragmentation elements and said plurality of fragmentation elements are held between said inner and outer shells.

* * * * *